US006279790B1

(12) United States Patent
Nomura et al.

(10) Patent No.: US 6,279,790 B1
(45) Date of Patent: Aug. 28, 2001

(54) SUBMERGED ENTRY NOZZLE FOR USE IN CONTINUOUS CASTING

(75) Inventors: Osamu Nomura; Shigeki Uchida; Wei Lin; Manabu Kasuu, all of Tokyo (JP)

(73) Assignee: Shinagawa Refractories Co., Ltd., Tokyo (JP)

( * ) Notice: Subject to any disclaimer, the term of this patent is extended or adjusted under 35 U.S.C. 154(b) by 0 days.

(21) Appl. No.: 09/527,575

(22) Filed: Mar. 16, 2000

(30) Foreign Application Priority Data

Mar. 18, 1999 (JP) ..... 11-074599

(51) Int. Cl.[7] ..... B22D 35/00
(52) U.S. Cl. ..... 222/606; 222/594
(58) Field of Search ..... 222/606, 594

(56) References Cited

U.S. PATENT DOCUMENTS 5,370,370 12/1994 Benson ..... 222/606
5,681,499 10/1997 Benson et al. ..... 222/606
5,908,577 * 6/1999 Yamamura ..... 222/606

FOREIGN PATENT DOCUMENTS 826 447 3/1998 (EP) .
57003764 * 1/1982 (JP) .
3243258 10/1991 (JP) .
11197825 7/1999 (JP) .

* cited by examiner

*Primary Examiner*—Scott Kastler
(74) *Attorney, Agent, or Firm*—Sughrue, Mion, Zinn, Macpeak & Seas, PLLC

(57) ABSTRACT

This invention relates to a submerged entry nozzle for use in a continuous casting process, which includes a main body portion 11 formed by an AG refractory material; an internal hole portion 12 made of a graphite-less refractory material which contains 90 wt % or more of a spinel, with a total content of other components being 10 wt % or less; portions 13 surrounding the discharge openings, which are formed by a graphite-containing refractory material containing 5 to 35 wt % of a graphite, 65 wt % or more of a spinel ($MgO—Al_2O_3$), with a total content of other components being 10 wt % or less; and a powder line portion 14 formed by a $ZrO_2$—C refractory material. The present submerged entry nozzle is suitable for use in casting various types of steel such as high concentration oxygen-containing steel, high concentration Mn-containing steel, Ca-treated steel, and stainless steel.

5 Claims, 8 Drawing Sheets

SUBMERGED ENTRY NOZZLE FOR USE IN CONTINUOUS CASTING

BACKGROUND OF THE INVENTION

1. Field of the Invention

This invention relates to a submerged entry nozzle for use in a continuous casting process, in particular to a submerged entry nozzle for use in a continuous casting process suitable for casting various types of steel such as high concentration oxygen-containing steel, high concentration Mn-containing steel, Ca-treated steel, stainless steel.

2. Description of the Related Art

During a process of continuously casting steel, a submerged entry nozzle is usually employed to introduce molten steel from a tundish into a mold.

FIG. 8 is a cross sectional view schematically showing a typical structure of a submerged entry nozzle made according to the prior art. As shown in FIG. 8, within the main body 1 of a conventional submerged entry nozzle there are formed a vertically arranged elongated internal hole 2 and a plurality of discharge openings 3 arranged exactly perpendicular or generally perpendicular to the internal hole 2. The molten steel from the tundish is at first introduced into the internal hole 2 and then caused to flow in different directions through the discharge openings 3, thereby allowing the molten steel to be injected uniformly into a mold.

Conventionally, one of the most widely used submerged entry nozzles has been an $Al_2O_3$—$SiO_2$—C (hereinafter, simply referred to as "AG") submerged entry nozzle.

FIG. 7 is another cross sectional view schematically indicating pattern for arranging different materials in a conventional AG submerged entry nozzle. As shown in FIG. 7, a mold powder line portion 14 of the nozzle is formed by a $ZrO_2$—C material, with other portions, i.e., the main body portions 11 of the submerged entry nozzle being formed of an AG material.

Although such an AG submerged entry nozzle has excellent resistance against spalling, when a submerged entry nozzle is used in a process for casting various types of steels such as high concentration oxygen-containing steel, high concentration Mn-containing steel, Ca-treated steel and stainless steel, abnormal melting loss will often occur. Due to such melting loss in an AG submerged entry nozzle, there will occur changes in the composition of the steel being cast, in particular undesirable increases in the carbon concentration of the cast product.

The above phenomenon will not only cause problems with shortened usable submerged entry nozzle life, but also troubles in the steel manufacturing process. For this reason, an extremely important technical task is to develop a new type submerged entry nozzle which does not produce the above problems.

On the other hand, in order to solve the above problems, improved submerged entry nozzles have been suggested whose internal surface is formed by a carbonless refractory material containing not over 5 wt % of $SiO_2$ but containing 90 wt % or more of one or more substances selected from the group consisting of $Al_2O_3$, MgO, $ZrO_2$ (Japanese Patent Laid-Open No. 3-243258).

In order to solve the above problems, the inventors of the present invention have carried out a research on the mechanism of melting loss in an AG submerged entry nozzle under conditions where it is used for casting various types of steel such as high concentration oxygen-containing steel, high concentration Mn-containing steel, Ca-treated steel, stainless steel. The mechanism which the inventors have found will be discussed in the following.

Namely, when a refractory material is in contact with molten steel, graphite on the working surface will be quickly dissolved into the molten steel, causing a phenomenon which may be represented by the following equation:

$$C(s)=\underline{C} \quad (1)$$

As a result, the working surface will become just $Al_2O_3$—$SiO_2$ oxides.

After that, when the steel to be cast is high concentration oxygen-containing steel, high concentration Mn-containing steel or stainless steel molten, $\underline{Mn}$ and $\underline{O}$ and Fe in the molten steel will penetrate, in the form of MnO and FeO, into the working surface, causing a phenomenon which may be represented in the following equations.

$$\underline{Mn}+\underline{O}=(MnO) \quad (2)$$

$$Fe+\underline{O}=(FeO) \quad (3)$$

Further, MnO—FeO type inclusion substances will impinge and adhere to the working surface.

The penetrated MnO and FeO penetrated from the above two sorts of phenomenon will react with the $Al_2O_3$ and $SiO_2$ on the working surface, thereby forming a liquid $Al_2O_3$—$SiO_2$—MnO—FeO type slag.

Since such a liquid slag is likely to flow away with the flow of the molten steel, the refractory material forming the submerged entry nozzle will suffer from a problem called melting loss.

Further, if the steel to be cast is Ca-treated steel, $\underline{Ca}$ will reduce $Al_2O_3$ or $SiO_2$, thereby forming CaO and thus causing a phenomenon which may be represented in the following equations:

$$SiO_2(s)+2\underline{Ca}=2(CaO)+\underline{Si} \quad (4)$$

$$Al_2O_3(s)+3\underline{Ca}=3(CaO)+2\underline{Al} \quad (5)$$

Such a CaO will penetrate the working surface.

Further, CaO—$Al_2O_3$ type inclusion substances will impinge and adhere to the working surface.

As a result, on the working surface a liquid CaO—$Al_2O_3$—$SiO_2$ type slag will be formed, so that the refractory material forming a submerged entry nozzle will also suffer from melting loss.

As may be clearly understood from the above discussion, the nozzle described in the above Japanese Patent Laid-Open No. 3-243258 encounters some problems which may be summerized as follows.

1) Even if a refractory material contains 90 wt % or more of $Al_2O_3$, $ZrO_2$, some undesired reactions represented by the above equations (2) to (5) will still occur, and some unwanted inclusion substances in a molten steel will similarly adhere to the working surface. As a result, it is impossible to avoid the formation of a liquid slag on the working surface and the melting loss of the refractory material forming the nozzle (such a melting loss is usually caused by such formation of liquid slag).

2) Further, in a case where a refractory material containing 90 wt % or more of $Al_2O_3$, $ZrO_2$ particularly MgO has been arranged to form the internal surface of the submerged entry nozzle including the discharge openings of the nozzle, it is likely that some cracks will occur in the vicinity of the discharge openings.

The reason for the above problem is that a refractory material containing 90 wt % or more of $Al_2O_3$, $ZrO_2$ or particularly MgO has a large coefficient of thermal expansion. Further, in the vicinity of the discharge openings of the submerged entry nozzle, there are many working surfaces that are subject to thermal shock, resulting in complex shapes where stress is likely to collect.

The inventors of the present invention, in accordance with the above findings and in view of the above problems, have suggested "a submerged entry nozzle having sufficient melting loss resistance and sufficient thermal shock resistance, which can be effectively used in a casting process suitable for casting various types of steel such as a high concentration oxygen-containing steel, high concentration Mn-containing steel, Ca-treated steel, stainless steel" (Japanese Patent Application No. 10-6143).

SUMMARY OF THE INVENTION

Accordingly, the inventors of the present invention have continued further with their research on the basis of their previous invention, trying to improve some manufacturing conditions such as a filling formability and sintering workability of a refractory material. Therefore, an object of the present invention is to provide an improved submerged entry nozzle which has sufficient melting loss resistance and sufficient thermal shock resistance, so that it is suitable for use in casting various types of steel such as high concentration oxygen-containing steel, high concentration Mn-containing steel, Ca-treated steel, stainless steel. Further, the submerged entry nozzle of the present invention may also be manufactured under improved conditions at reduced production costs.

Moreover, on the basis of their previously obtained findings concerning chemical reactions between the molten steel and refractory material and concerning the thermal stress of a submerged entry nozzle (suggested in their previous invention), the inventors of the present invention have also conducted diligent research on a process for manufacturing such a submerged entry nozzle, thereby accomplishing the present invention.

Namely, a submerged entry nozzle for continuous casting according to the present invention is an improved submerged entry nozzle usually for use in introducing a molten steel from a tundish into a mold, characterized in that at least part of the portions surrounding the nozzle discharge openings, preferably most portions thereof, are made of a graphite-containing refractory material containing 5 to 35 wt % graphite, 65 wt % or more of a spinel ($MgO—Al_2O_3$), with a total content of other components being 10 wt % or less; at least part of the internal wall material within the nozzle, preferably most portions thereof, being made of a graphite-less refractory material containing 90 wt % or more of a spinel, with a total content of other components being 10 wt % or less.

Further, the submerged entry nozzle for continuous casting according to the present invention is characterized in that the content of MgO in the spinel is 20 to 45 wt %, and the content of $Al_2O_3$ in the spinel is 55 to 80 wt %.

Moreover, the submerged entry nozzle for continuous casting according to the present invention is characterized in that it employs a refractory raw material which is comprised of a spinel material with a particle size distribution such that particles of 1 mm or less are contained in an amount of 95 wt % or more, and particles of 0.5 mm or less are contained in an amount of 70 wt % or more.

Furthermore, the submerged entry nozzle for continuous casting according to the present invention is characterized in that the nozzle internal hole portion containing the spinel has a thickness of 1 to 10 mm.

In addition, the submerged entry nozzle for continuous casting according to the present invention is characterized in that it has an integrally formed structure in which the portions surrounding the discharge openings, the nozzle internal hole portion and the nozzle main body portion, or the portions in powder line with the above portions have been formed simultaneously into an integral structure during a formation process.

DETAILED DESCRIPTION OF THE INVENTION

Figure 1:
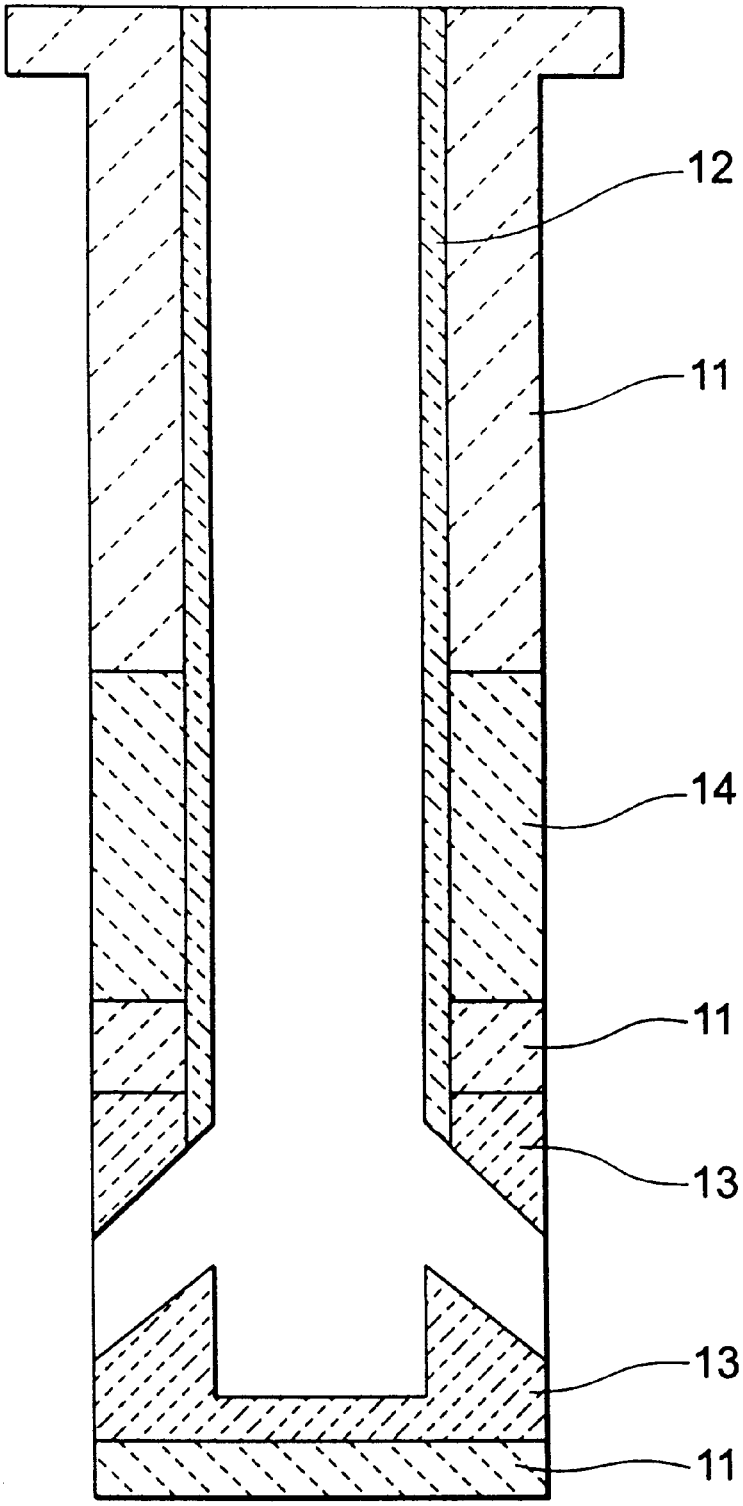
FIG. 1 is a sectional view schematically indicating a nozzle made according to a first embodiment of the present invention.

In the following, the submerged entry nozzle for continuous casting according to the present invention (hereinafter, simply referred to as "the nozzle of the present invention") will be described in more detail.

First, the nozzle of the present invention is characterized in that at least part of the surrounding portions around the nozzle discharge openings, preferably most portions thereof, are made of a graphite-containing refractory material containing 5 to 35 wt % of a graphite, 65 wt % or more of a spinel ($MgO—Al_2O_3$), with a total content of other components being 10 wt % or less (including cases not containing said other components); at least one part of the internal wall material within the nozzle, preferably most portions thereof, is made of a graphite-less refractory material, but containing 90 wt % or more of a spinel, with a total content of other components being 10 wt % or less (including cases not containing said other components).

The reason why it is necessary to form the above composition may be explained based on the findings obtained by the inventors of the present invention. Namely, MnO, FeO or CaO in the spinel has an extremely large thermo-dynamic activity, and the reactions shown in the above equations (2) to (5) are not likely to occur, hence making it difficult for the MnO, FeO or CaO in a molten steel to penetrate into the spinel.

In this way, when the spinel is used as a main component of an aggregate of a refractory material forming a working surface of the nozzle, even if the nozzle is employed to cast various types of steel such as high concentration oxygen-containing steel, high concentration Mn-containing steel, Ca-treated steel and stainless steel, melting loss is not likely to occur in the nozzle.

One of the most important points with respect to the nozzle of the present invention is how to control the mineral composition of a refractory material. Namely, even if several components may be similar to one another, when they have different mineral structures (different crystal structures), they will have different reactivities when reacting with a molten steel. As a result, the melting loss of one component will differ greatly from that of another. For example, if a comparison is made between spinel and a material formed by mixing together MgO and $Al_2O_3$, it will be found that although they have similar chemical compositions, it is spinel that has a remarkably higher melting loss resistance.

In the present invention, the expression "spinel (MgO—$Al_2O_3$)" represents a spinel having a theoretical composition with a molecular formula of $MgO.Al_2O_3$, and/or a spinel having a non-theoretical composition rich in MgO, and/or a spinel having a non-theoretical composition rich in $Al_2O_3$ (however, those rich in MgO or in $Al_2O_3$ do not exist in a free state).

Further, apart from the spinel which servers as a main component for forming the above refractory material, as other components it is allowed to include in the refractory material one or more of the following substances, in view of conditions for manufacturing the nozzle and conditions for casting a steel using the nozzle, thereby allowing the thus formed refractory material to have improved sinterability, improved filling formability and improved resistance against atmospheric oxidation. Here, the above-mentioned other components may be oxides such as CaO, BaO, BeO, MgO, $ZrO_2$, $Al_2O_3$, $SiO_2$, $Cr_2O_3$, $NbO_2$, $V_2O_3$, $K_2O$, $Na_2O$, a titanium oxide iron oxide, manganese oxide and rare earth oxides (such as $Y_2O_3$, $CeO_2$), carbides such as SiC, $Al_4C_3$, TiC, ZrC, NbC, VC, $Cr_3C_2$, $B_4C$, nitrides such as $Si_3N_4$, AlN, BN, borides such as $ZrB_2$, $TiB_2$, $VB_2$, $CrB_2$, $W_2B_5$, oxidated nitrides such as ALON, SIALON, metal or intermetallic compounds such as Al, Si, Fe, Mo, Mn, W, ZrSi, $FeSi_2$.

However, it is preferred that the mixing amount of any of the above substances be 10 wt % or less. If the mixing amount is larger than 10 wt %, melting loss resistance of the nozzle will be deteriorated.

Further, since at least part of the adjacent portions surrounding the nozzle discharge openings, preferably most portions thereof, contain 5 to 35 wt % graphite, the nozzle has good thermal shock resistance, thus preventing possible cracks. Moreover, the concentration of carbon dissolved from the nozzle into the molten steel is so small that it can be ignored.

If the content of the graphite is 5 wt % or less, the thermal shock resistance of the nozzle will be poor, causing cracking during use.

On the other hand, if the content of the graphite is 35 wt % or more, there will occur a reaction represented by the above equation (1), causing the graphite to dissolve into the molten steel, hence bringing about a heavy damage to the nozzle. In addition, the molten steel will have increased carbon concentration due to carbon dissolving carbon from the nozzle. However, such increased carbon concentration in the molten steel is not desirable.

Moreover, in the present invention, since at least part, and preferably most of the internal hole portion (having a large area which will come in contact with the molten steel) of the nozzle, is made of a material not containing graphite, the concentration of carbon dissolved from the nozzle into the molten steel is so small that it can be ignored.

On the other hand when, manufacturing the nozzle, if an organic binder is added as a combining agent during a kneading step, such a binder will decompose when sintering the nozzle. Thus, even if a small amount of remaining binder is left as residual carbon in the refractory material, no problems harmful to the nozzle will occur, provided that the small amount of residual carbon is 5 wt % or less. In such an example, the refractory material forming the nozzle may be considered to be a graphite-less refractory material.

Next, the nozzle for continuous casting according to the present invention is characterized in that the content of MgO in the spinel is 20 to 45 wt %, and the content of $Al_2O_3$ in the spinel is 55 to 80 wt %.

In view of the theoretical structure in the spinel, it is understood that a larger weight ratio of spinel phase ($MgO.Al_2O_3$) will ensure a smaller amount of MnO, FeO or CaO penetrating from the molten steel to the spinel, thereby enabling the spinel to increase its melting loss resistance.

If the content of MgO in the spinel is less than 20 wt % or larger than 45 wt %, or if the content of $Al_2O_3$ in the spinel is less than 55 wt % or larger than 80 wt %, the weight ratio of the spinel phase in a theoretical structure will become too small, causing the spinel to lose its melting loss resistance, thus it is not desirable.

Further, the nozzle of the present invention is characterized in that it employs a refractory raw material which is comprised of a spinel material whose particle size is distributed such that particles having a size of 1 mm or less are contained in an amount of 95 wt % or more, and particles having a size of 0.5 mm or less are contained in an amount of 70 wt % or more.

If the amount of spinel material having a particle size of more than 1 mm is larger than 5 wt %, the particle size of the raw material will be too large. As a result, the refractory structure of the nozzle when in use, particularly the refractory structure surrounding the discharge openings through which the molten steel flow is violent, will become fragile and thus cause the refractory particles to drop off. On the other hand, if the amount of spinel material having a particle size of less than 0.5 mm is less than 70 wt %, a desired formability when forming the nozzle will be deteriorated, hence making it difficult to obtain a nozzle having a desired shape.

In the present invention, the expression "the particle size of spinel refractory material" is used to mean the particle size of the spinel material itself which is used as a refractory raw material and/or the particle size of a refractory raw material for forming the spinel material.

Further, the nozzle of the present invention is characterized in that the nozzle internal hole portion containing the spinel has a thickness of 1 to 10 mm.

If the above thickness is less than 1 mm, the strength of the internal hole portion will be too weak, making it difficult to endure the impact caused by the flowing of a molten steel, producing an undesired possibility that the internal hole portion will peel off from the nozzle main body. On the other hand, if the above thickness is larger than 10 mm, the thermal expansion difference between the internal hole portion and the refractory material forming the nozzle main body will be too large. As a result, there is a fear that cracks will develop in the internal hole portion (its thermal shock resistance will be deteriorated), thus it is not desirable.

Moreover, the nozzle of the present invention is characterized in that it has an integrally formed structure in which different but adjacent portions have been formed simultaneously into an integral structure during a formation process.

In contrast, if a nozzle has a structure obtained by forming an internal hole portion and adjacent portions surrounding the discharge openings (all containing the spinel material) independently of the nozzle main body and then inserting these portions into the nozzle main body, it is likely that an undesired slot will occur between the internal hole portion and the above surrounding portions, hence causing these portions to peel off from the nozzle main body.

Moreover, if a nozzle having the above structure is manufactured, the manufacturing process will be extremely complex because it involves too many steps, hence increasing the production cost.

Accordingly, in a process for manufacturing the nozzle of the present invention, a binder such as a phenol resin or a polysaccharide is added and mixed (kneaded) into the refractory raw material for forming the nozzle internal hole portion and the portions surrounding the discharge openings, and also into the refractory raw material for forming the nozzle main body. Subsequently, the kneaded mixtures are filled into predetermined positions in a mold. After that, CIP (Cold Isostatic Pressing) or a similar method is used to pressure form the nozzle, followed by drying, firing or non-firing, to thereby complete the manufacturing process.

As a refractory material for forming the nozzle main body of the present invention, an AG refractory material which has long been used conventionally may be used. As the chemical composition of the refractory material, a conventionally used composition, for example, 30 to 90 wt % $Al_2O_3$, 0 to 35 wt % $SiO_2$and 10 to 35 wt % C may be used. Further, in the mold powder line portion of the main body, a conventional $ZrO_2$—C refractory material in which $ZrO_2$ is 60 to 90 wt % and C is 10 to 30 wt % may be used.

As a method for forming discharge openings in the nozzle of the present invention, a conventional method for forming discharge openings in a conventional AG submerged entry nozzle may be used. Namely, according to the method a related above, a nozzle is first formed, then a drying treatment is carried out. Subsequently, a lathe is used to cut openings at predetermined positions of the nozzle. The adjacent portions surrounding the discharge openings of the nozzle contain 5 wt % graphite, and have good workability, so that it is easy to form the discharge openings in the nozzle with the use of such a method.

In this way, the nozzle of the present invention may be manufactured in a simplified process involving fewer steps with reduced cost, so that such a nozzle is suitable for mass production on an industrial scale.

Next, embodiments of the present invention will be described with reference to the accompanying drawings. However, the present invention should not be limited by the following embodiments.

(First Embodiment)

FIG. 1 is a sectional view (showing material arrangement pattern 1) schematically indicating a nozzle made according to a first embodiment of the present invention. In FIG. 1, reference numeral 11 represents a main body portion formed by an AG refractory material, reference numeral 12 represents an internal hole portion made of a graphite-less refractory material which contains 90 wt % or more of a spinel, with the remainder being 10 wt % or less. Reference numeral 13 represents portions surrounding the discharge openings, which is formed by a graphite-containing refractory material containing 5 to 35 wt % of a graphite, 65 wt % or more of a spinel ($MgO—Al_2O_3$), with a total content of other components being 10 wt % or less. Reference numeral 14 represents a powder line portion formed by a $ZrO_2$—C refractory material.

(Second Embodiment)

Figure 2:
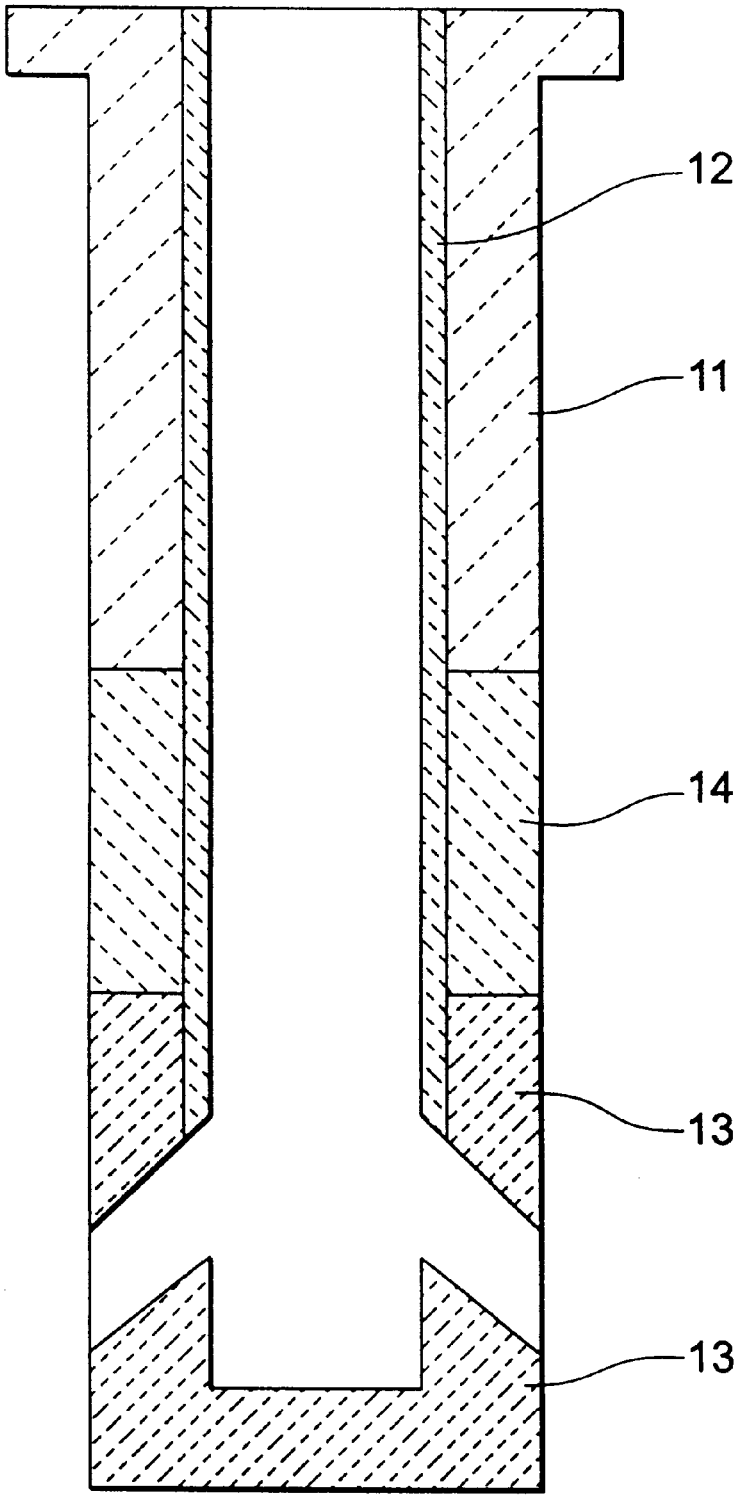
FIG. 2 is a sectional view schematically indicating a nozzle made according to a second embodiment of the present invention.

FIG. 2 is a sectional view (showing material arrangement pattern 2) schematically indicating a nozzle made according to a second embodiment of the present invention. In FIG. 2, reference numeral 11 represents a main body portion formed by an AG refractory material, reference numeral 12 represents an internal hole portion made of a graphite-less refractory material which does not contain a graphite, but contains 90 wt % or more of a spinel, with the remainder being 10 wt % or less. Reference numeral 13 represents portions surrounding the discharge openings, which is formed by a graphite-containing refractory material containing 5 to 35 wt % of a graphite, 65 wt % or more of a spinel ($MgO—Al_2O_3$), with a total content of other components being 10 wt % or less. Reference numeral 14 represents a powder line portion formed by a $ZrO_2$—C refractory material.

(Third Embodiment)

Figure 3:
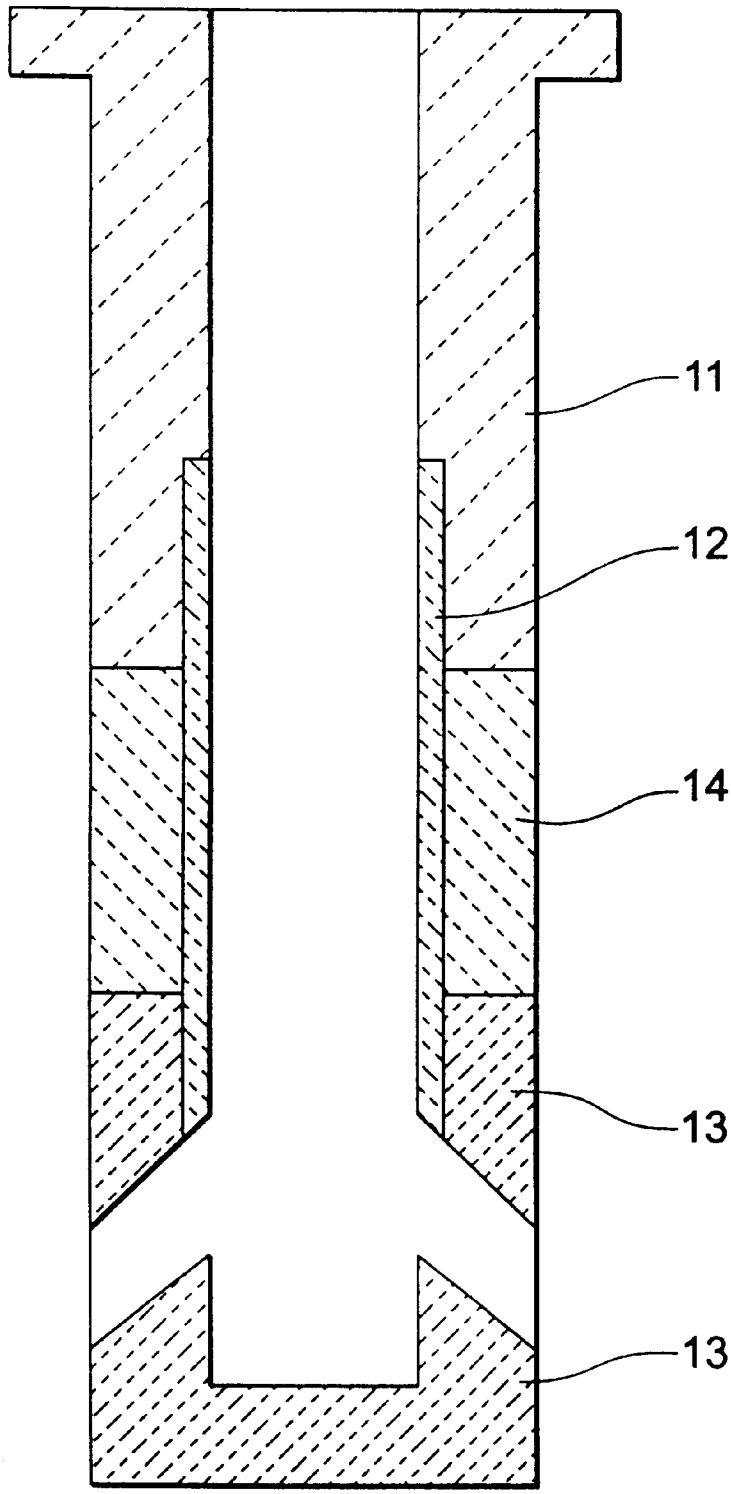
FIG. 3 is a sectional view schematically indicating a nozzle made according to a third embodiment of the present invention.

FIG. 3 is a sectional view (showing material arrangement pattern 3) schematically indicating a nozzle made according to a third embodiment of the present invention. In FIG. 3, reference numeral 11 represents a main body portion formed by an AG refractory material, reference numeral 12 represents an internal hole portion made of a graphite-less refractory material which contains 90 wt % or more of a spinel, with the remainder being 10 wt % or less. Reference numeral 13 represents surrounding portions around the discharge openings, which is formed by a graphite-containing refractory material containing 5 to 35 wt % graphite, 65 wt % or more of a spinel ($MgO—Al_2O_3$), with a total content of other components being 10 wt % or less. Reference numeral 14 represents a powder line portion formed by a $ZrO_2$—C refractory material.

(Fourth Embodiment)

Figure 4:
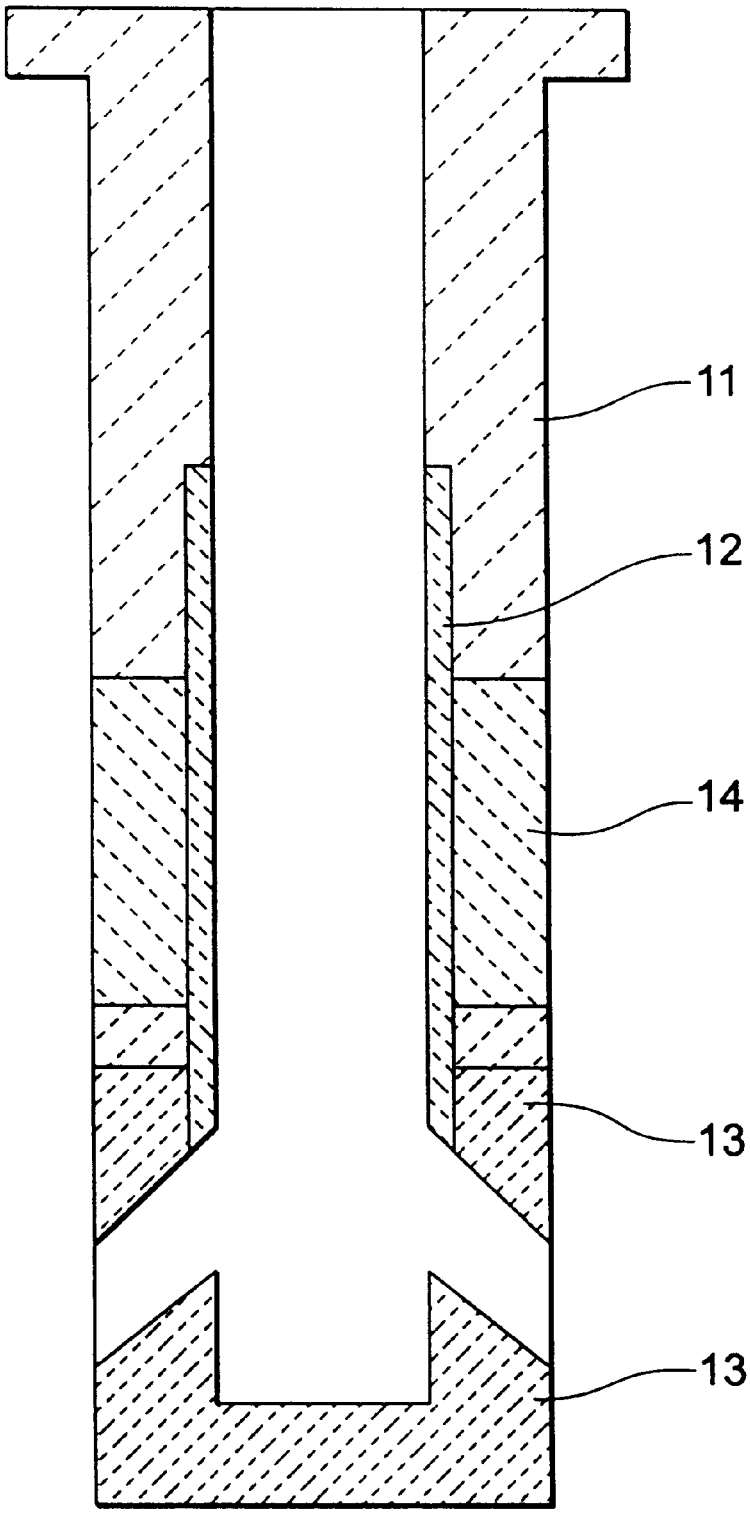
FIG. 4 is a sectional view schematically indicating a nozzle made according to a fourth embodiment of the present invention.

FIG. 4 is a sectional view (showing material arrangement pattern 4) schematically indicating a nozzle made according to a fourth embodiment of the present invention. In FIG. 4, reference numeral 11 represents a main body portion formed by an AG refractory material, reference numeral 12 represents an internal hole portion made of a graphite-less refractory material which contains 90 wt % or more of a spinel, with the remainder being 10 wt % or less. Reference numeral 13 represents portions surrounding the discharge openings, which is formed by a graphite-containing refractory material containing 5 to 35 wt % graphite, 65 wt % or more of a spinel ($MgO—Al_2O_3$), with a total content of other components being 10 wt % or less. Reference numeral 14 represents a powder line portion formed by a $ZrO_2$—C refractory material.

(Fifth Embodiment)

Figure 5:
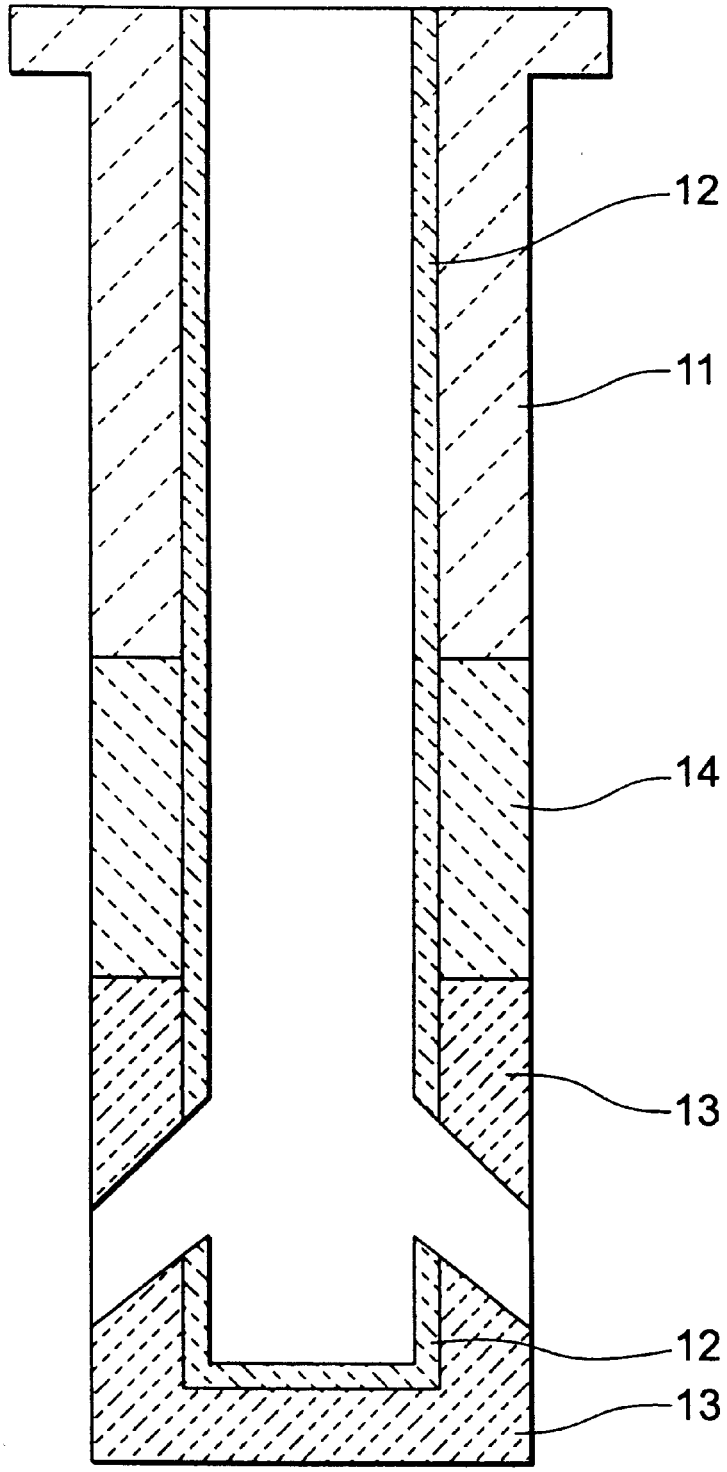
FIG. 5 is a sectional view schematically indicating a nozzle made according to a fifth embodiment of the present invention.

FIG. 5 is a sectional view (showing material arrangement pattern 5) schematically indicating a nozzle made according to a fifth embodiment of the present invention. In FIG. 5, reference numeral 11 represents a main body portion formed by an AG refractory material, reference numeral 12 represents an internal hole portion made of a graphite-less refractory material which contains 90 wt % or more of a spinel, with the remainder being 10 wt % or less. Reference numeral 13 represents portions surrounding the discharge openings, which is formed by a graphite-containing refractory material containing 5 to 35 wt % graphite, 65 wt % or more of a spinel ($MgO—Al_2O_3$), with a total content of other components being 10 wt % or less. Reference numeral 14 represents a powder line portion formed by a $ZrO_2$—C refractory material.

Further, in order to make the present invention more clearly understandable, there is indicated another material arrangement pattern as follow for the purpose of comparison.

Figure 6:
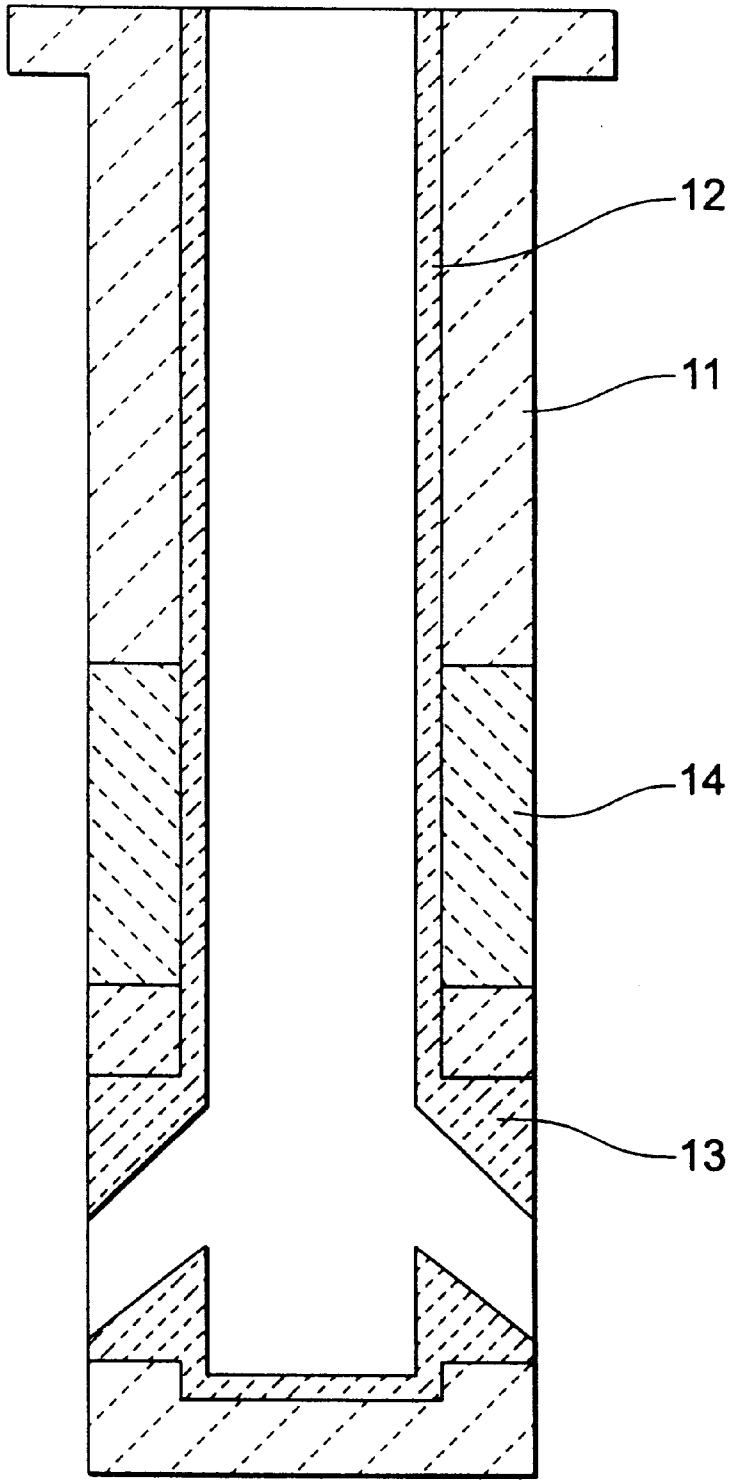
FIG. 6 is a sectional view schematically indicating a material arrangement pattern of a submerged entry nozzle made according to a comparative example.

FIG. 6 is a sectional view schematically indicating a material arrangement pattern which is different from the material arrangement patterns 1 to 5 shown in the first to fifth embodiments of the present invention. In FIG. 6, reference numeral 11 represents a main body portion formed by an AG refractory material. Different from the first to fifth embodiments (in the above material arrangement patterns 1 to 5, a refractory material used to form the internal hole portion is different from the refractory material used to form the surrounding portions around the discharge openings), a refractory material used to form the internal hole portion 12 is different from the refractory material used to form the portions 13 surrounding the discharge openings. Namely, in material arrangement pattern 6, the internal hole portion 12 and the portions 13 surrounding the discharge openings are formed by the same refractory material which does not contain graphite but contains 90 wt % or more of a spinel, with the remainder being 10 wt % or less. Then, reference numeral 14 represents a powder line portion formed by a $ZrO_2$—C refractory material.

EXAMPLES

Next, some examples of the present invention will be explained in detail by way of Examples and Comparative examples. First, various experimental examples will be explained in the following.

Experimental Examples

The raw materials of the mineral phase shown in Table 1 were blended together in accordance with the composition percentages shown in Table 1, thereby obtaining mixtures (samples) for use as raw materials, which are inventive samples 1 to 8 for use in the present invention and comparative samples 1 to 6 for comparison.

Then, various tests for valuation were carried out with the use of the above inventive samples 1 to 8 and comparative samples 1 to 6.

1. As a result, it was found that a smaller melting loss index will produce better melting loss resistance.

Further, the same experiments were also conducted with respect to other molten steels including high concentration Mn-containing steel, Ca-treated steel and a stainless steel, with the experiment results shown in Table 1.

The following facts can be understood from Table 1.

1) With any of the above molten steels, each of the inventive samples 1 to 8 exhibits extremely small melting loss.

2) With any of the above molten steels, commonly used AG refractory material which is comparative sample 1 had the largest melting loss. Then, comparative sample 2 had the second largest melting loss, with the melting loss of comparative samples 3, 6, 4, 5 being listed in a gradually decreasing direction. However, with comparative samples 4 and 5, many cracks had occurred.

3) As to possible influence caused by graphite amount and brought to the melting loss, when the inventive samples 4, 5 and 6 were compared with comparative sample 6, it was found that there would be almost no such influence, provided that the graphite amount is 35 wt % or less.

Examples 1 to 3, Comparative Examples 1 to 4

In Examples 1 to 3 of the present invention, as shown in Table 2, the inventive samples 1, 6 and 7 were used to form

TABLE 1

| | | Samples for use in the Present invention | | | | | | | | Samples for use in the Comparative Examples | | | | | |
|---|---|---|---|---|---|---|---|---|---|---|---|---|---|---|---|
| | | 1 | 2 | 3 | 4 | 5 | 6 | 7 | 8 | 1 | 2 | 3 | 4 | 5 | 6 |
| Components wt % | $Al_2O_3$ | 72 | 77 | 58 | 61 | 55 | 45 | 64 | 50 | 55 | — | 100 | — | 50 | 42 |
| | MgO | 28 | 23 | 42 | 24 | 20 | 20 | 26 | 20 | — | — | — | 100 | 50 | 18 |
| | $ZrO_2$ | — | — | — | — | — | — | 2 | — | — | 95 | — | — | — | — |
| | $SiO_2$ | — | — | — | — | — | — | 2 | 2 | 20 | — | — | — | — | — |
| | Graphite | — | — | — | 15 | 25 | 35 | — | 20 | 20 | — | — | — | — | 40 |
| | Others | — | — | — | — | — | — | 6# | 8* | SiC5 | CaO5 | — | — | — | — |
| Main mineral phase | | S | S | S | S, G | S, G | S, G | S | S, G | M, G | Z | C | P | C, P | S, G |
| Melting loss index | High concentration oxygen-containing steel | 0.1 | 0.1 | 0.1 | 0.1 | 0.1 | 0.2 | 0.1 | 0.1 | 1 | 0.7 | 0.6 | 0.4 | 0.4 | 0.5 |
| | High concentration Mn-containing steel | 0.1 | 0.1 | 0.1 | 0.1 | 0.1 | 0.2 | 0.1 | 0.1 | 1 | 0.6 | 0.6 | 0.4 | 0.4 | 0.4 |
| | Ca-treated steel | 0.1 | 0.1 | 0.1 | 0.1 | 0.1 | 0.2 | 0.1 | 0.1 | 1 | 0.5 | 0.7 | 0.4 | 0.4 | 0.5 |
| | Stainless steel | 0.1 | 0.1 | 0.1 | 0.1 | 0.1 | 0.2 | 0.1 | 0.1 | 1 | 0.6 | 0.6 | 0.4 | 0.4 | 0.4 |

Note)
#: CaO: 2, $TiO_2$: 2, $Fe_2O_3$: 2 wt %
*CaO: 2, $TiO_2$: 2, Al: 4 wt %
S: Spinel, P: Periclase, M: Mullite, Z: Zirconia, C: Corundum, G: Graphite
The particle size of the raw material used was 0.5 mm or less.

<Tests for Evaluating Melting Loss Resistance>

The above listed samples were dipped in molten steel, so as to conduct the predetermined experiment for evaluating the melting loss resistance of each sample.

A high concentration oxygen-containing steel was melted in a high frequency furnace under an argon atmosphere and kept at 1580° C. Then, the samples each having a diameter of 40 mm and a height of 230 mm were dipped in the molten steel, and the furnace was rotated at a velocity of 100 rpm for 60 minutes. After that, the diameter of each sample was measured to investigate its melting loss amount, thereby evaluating the melting loss resistance of each sample, based on a melting loss index with a melting loss amount of AG refractory material (which is a sample for comparison) being the internal hole portions, while the inventive samples 4, 8 were used to form the portions surrounding the discharge openings, thereby obtaining the nozzle of the present invention having the material arrangement patterns shown in FIGS. 1, 2 and 5.

Further, in Comparative Examples 1 and 2, as shown in Table 2, inventive samples 1 and 7 were used to form both the internal hole portion and the portions surrounding the discharge openings, thereby obtaining the nozzle of the comparative examples having the material arrangement pattern shown in FIG. 6.

Moreover, in Comparative Examples 3 and 4, as shown in Table 2, comparative samples 3 and 5 were used to form both the internal hole portion and the portions surrounding the discharge openings, thereby obtaining the nozzle of the comparative example having the material arrangement pattern shown in FIG. 6.

TABLE 2

| | | Examples | | | Comparative Examples | | | |
|---|---|---|---|---|---|---|---|---|
| | | 1 | 2 | 3 | 1 | 2 | 3 | 4 |
| Nozzle material | Material arrangement pattern | FIG. 1 | FIG. 2 | FIG. 5 | FIG. 6 | FIG. 6 | FIG. 6 | FIG. 6 |
| | Portions surrounding discharge openings | Inventive sample 8 shown in Table 1 | Inventive sample 4 shown in Table 1 | Inventive sample 6 shown in Table 1 | Inventive sample 1 shown in Table 1 | Inventive sample 7 shown in Table 1 | Inventive sample 3 shown in Table 1 | Inventive sample 5 shown in Table 1 |
| | Internal hole portion | Inventive sample 1 shown in Table 1 | Inventive sample 3 shown in Table 1 | Inventive sample 7 shown in Table 1 | Inventive sample 1 shown in Table 1 | Inventive sample 7 shown in Table 1 | Inventive sample 3 shown in Table 1 | Inventive sample 5 shown in Table 1 |
| Presence of cracks | | None | None | None | None | Yes | Yes | Yes |

Note):
Each main body portion is made of a comparative sample shown in Table 1, powder line portion is $ZrO_2$—C containing 85 wt % of $ZrO_2$ and 15 wt % of graphite. Each internal hole potion has a thickness of 5 mm.

<Tests for Evaluating Thermal Shock Resistance>

The nozzles of the present invention and the nozzles of the comparative examples were measured to investigate their thermal shock resistance with the use of the following testing method.

At first, each nozzle was made as a submerged entry nozzle having a size suitable for actual use. Then, the nozzles were dipped in 300 tons molten steel for 3 minutes without having preheated. Subsequently, the nozzles were taken out of the molten steel and air cooled, so as to confirm whether any cracks had generated in the nozzles. Further, the nozzles were cut at the middle portions thereof to confirm whether there were any internal cracks.

The test results are shown in Table 2.

As may be understood from Table 2, each of the comparative nozzles developed cracks, while none of the inventive nozzles produced such cracks, thereby proving that the nozzles made according to the present invention have an extremely excellent thermal shock resistance.

<Actual Casting Test>

With the use of the nozzles of the present invention and the nozzles made according to the comparative examples, continuous casting test was carried out for casting a high concentration oxygen-containing steel, a high concentration Mn-containing steel, a Ca-treated steel and a stainless steel.

As the nozzle according to the present invention, that made in Example 1 shown in FIG. 2 was used. As the nozzle made according to the comparative example, the conventional AG submerged entry nozzle shown in FIG. 7 was used.

The maximum melting loss amount (melting loss index) of each submerged entry nozzle after the above test with respect to various sorts of steels, together with the composition of each sort of steel, are shown in Table 3.

TABLE 3

Figure 7:
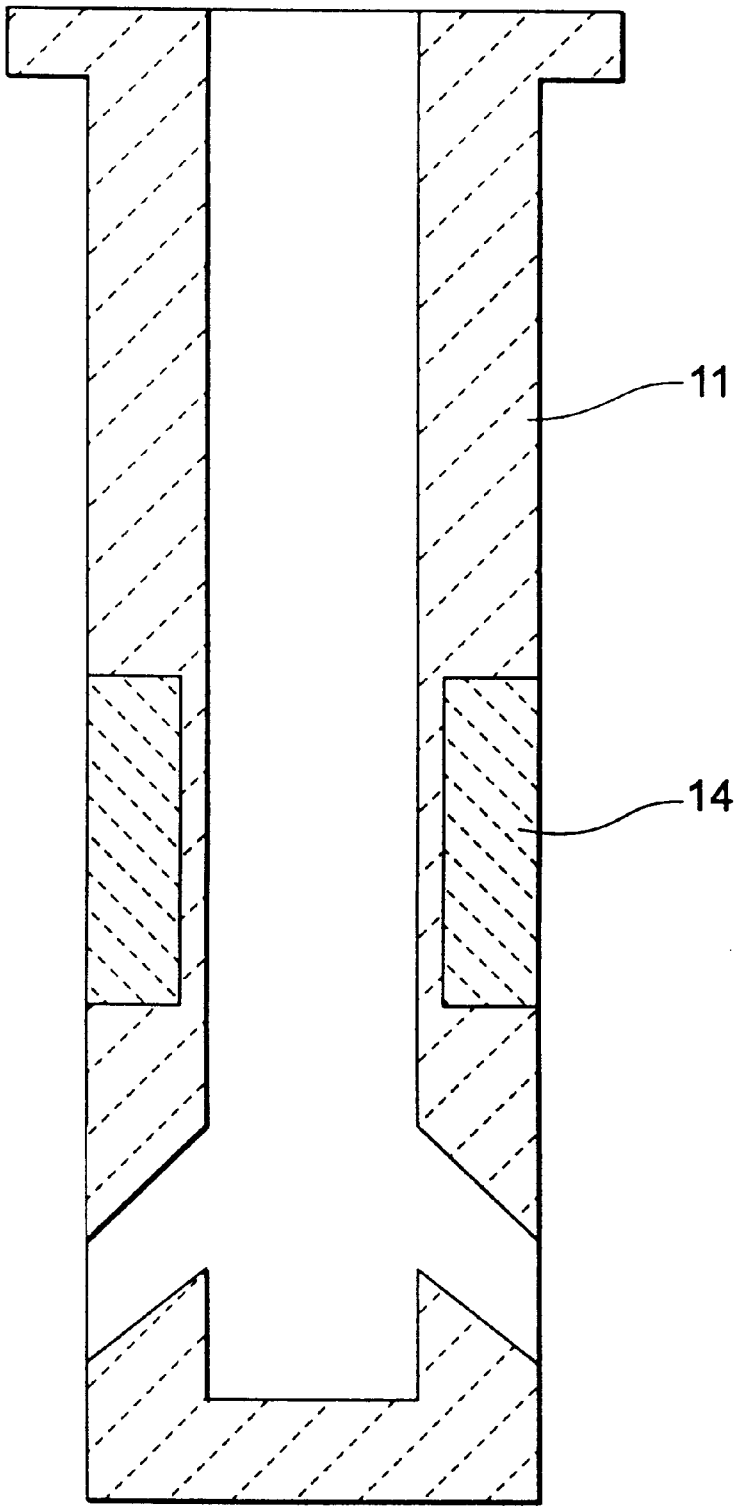
FIG. 7 PRIOR ART
FIG. 7 is a sectional view schematically indicating a material arrangement pattern of a nozzle made of an AG material according to the prior art.
Figure 8:
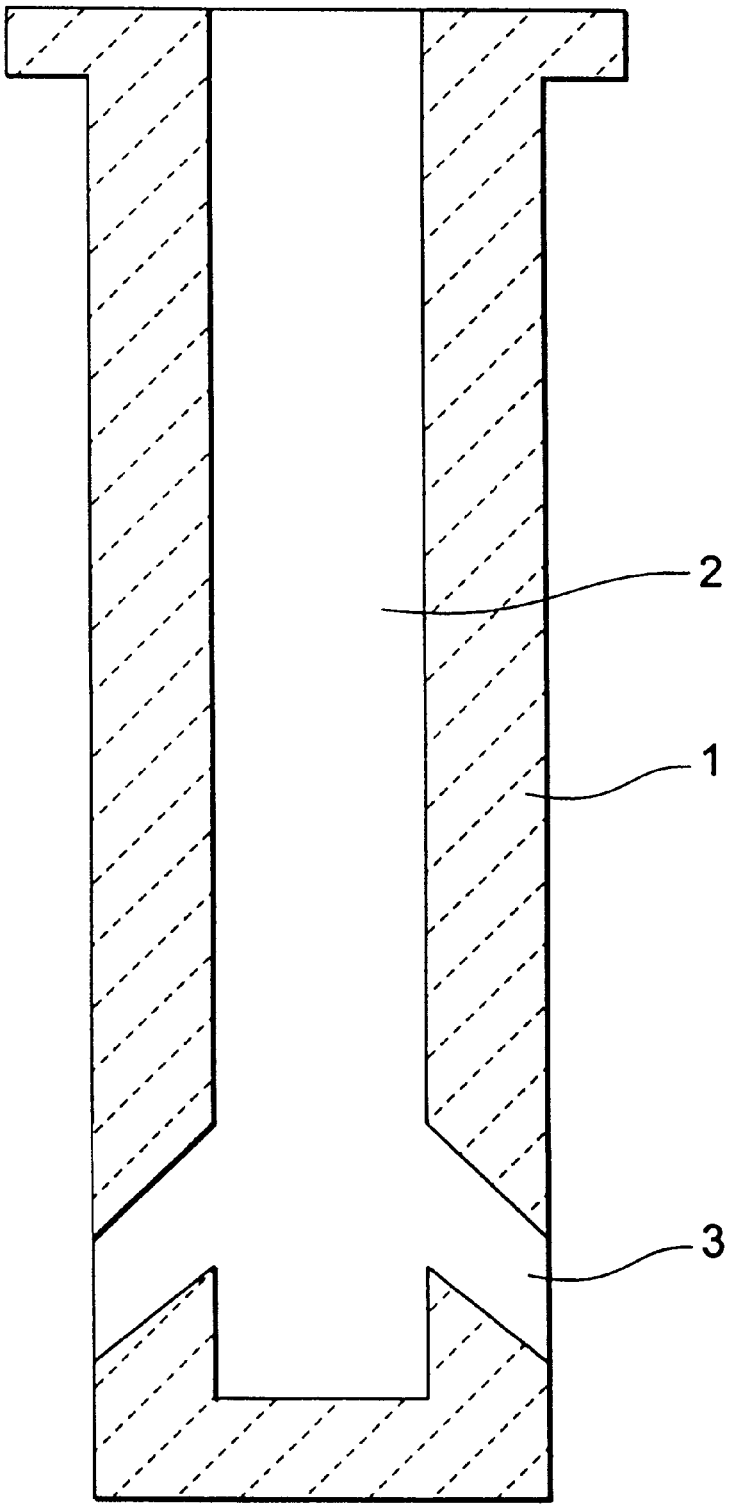
FIG. 8 PRIOR ART
FIG. 8 is a sectional view schematically indicating a typical shape of a submerged entry nozzle.

| | Chemical composition of steel (wt %) | | | | | | | Melting loss index | |
|---|---|---|---|---|---|---|---|---|---|
| | C | Si | Mn | P | S | Al | O | Example 1 | Conventional nozzle shown in FIG. 7 |
| High concentration oxygen-containing steel | 0.003 | 0.002 | 0.3 | 0.01 | 0.01 | — | 0.06 | 0.1 | 1 |
| High concentration Mn-containing steel | 0.040 | 0.020 | 2.0 | 0.01 | 0.03 | — | 0.010 | 0.1 | 1 |
| Ca-treated steel | 0.050 | 0.3 | 0.8 | 0.01 | 0.01 | 0.02 | Ca: 30 ppm | 0.1 | 1 |
| Stainless steel | 0.050 | 0.5 | 1.0 | 0.04 | 0.02 | Cr: 18 | 0.005 | 0.1 | 1 |
| Al-killed steel | 0.003 | 0.03 | 0.2 | 0.01 | 0.01 | 0.05 | 0.002 | Little adhesion | Clogging |

In any of the above cases, it was found that conventional AG submerged entry nozzles suffer from large melting loss, while the nozzles of the present invention suffer almost no melting loss, thereby exhibiting an extremely good melting loss resistance. Further, with any one of the nozzles of the present invention, there would be no cracks occur in nozzle itself, therefore ensuring safe casting process operations. In particular, it is possible to greatly reduce some defects (such as slivers, scabbing or the like), thereby ensuring improved quality steel products.

On the other hand, both the nozzles of the present invention and the conventional AG submerged entry nozzles were used in a test for casting Al-killed steel.

As a result, it was found that with the conventional AG submerged entry nozzles, thick $Al_2O_3$ layers were formed on the working surfaces thereof, hence clogging the openings of the nozzles. In contrast, with the nozzles of the present invention, there were no $Al_2O_3$ layers formed on the working surfaces thereof, thus avoiding clogging of the discharge openings of the nozzles. Namely, with the use of the nozzle of the present invention, clogging of the discharge openings of the nozzle can be effectively prevented.

Therefore, with the present invention a nozzle with good thermal shock resistance and high melting loss resistance can be easily manufactured.

Further, with the use of the nozzle of the present invention, it is possible to extend the usable life of the nozzle, improve the quality of a steel product made by using the nozzle, and ensure a stabilized casting process operation.

What is claimed is:

1. A submerged entry nozzle for use in a continuous casting process, said nozzle being employed to introduce a molten steel from a tundish into a mold:

wherein at least part of portions surrounding discharge openings in said nozzle, are made of a graphite-containing refractory material containing 5 to 35 wt % graphite, 65 wt % or more of a spinel ($MgO—Al_2O_3$), with a total content of other components being 10 wt % or less; and wherein at least part of internal wall material within the nozzle, is made of a graphite-less refractory material containing 90 wt % or more of a spinel, with a total content of other components being 10 wt % or less.

2. A submerged entry nozzle according to claim 1, wherein the content of MgO in the spinel is 20 to 45 wt %, and the content of $Al_2O_3$ in the spinel is 55 to 80 wt %.

3. A submerged entry nozzle according to claim 1 wherein said nozzle employs a refractory raw material which is comprised of a spinel material whose particle size is distributed such that particles having a size of 1 mm or less are contained in an amount of 95 wt % or more, and particles having a size of 0.5 mm or less are contained in an amount of 70 wt % or more.

4. A submerged entry nozzle according to claim 1, wherein the nozzle internal hole portion containing the spinel has a thickness of 1 to 10 mm.

5. A submerged entry nozzle according to claim 1, wherein said nozzle has an integrally formed structure in which the portions surrounding said discharge openings, the nozzle internal hole portion and the nozzle main body portion, or portions in powder line with the above portions are formed simultaneously into an integral structure during a formation process.

* * * * *